US011345003B1

(12) United States Patent
Newkirk et al.

(10) Patent No.: US 11,345,003 B1
(45) Date of Patent: May 31, 2022

(54) PLASTIC CLIP POPPER PLIERS AND METHOD OF USE

(71) Applicant: Robert Bosch GmbH, Stuttgart (DE)

(72) Inventors: Daniel Joseph Newkirk, Owatonna, MN (US); Dirk Charles Skogerboe, Faribault, MN (US); Mike Kawell, Granite Falls, NC (US)

(73) Assignees: Bosch Automotive Service Solutions Inc., Warren, MI (US); Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/951,071

(22) Filed: Nov. 18, 2020

(51) Int. Cl.
*B25B 27/14* (2006.01)
*B25B 27/00* (2006.01)
*B25B 27/18* (2006.01)

(52) U.S. Cl.
CPC ..... *B25B 27/14* (2013.01); *B25B 27/0035* (2013.01); *B25B 27/18* (2013.01)

(58) Field of Classification Search
CPC .. B25B 7/02; B25B 7/22; B25B 27/14; B25B 27/18; B25B 27/20; B25B 27/0035; B25B 27/205
USPC ..... 29/22, 28, 221, 223, 232, 243.56, 244, 29/248, 261, 267, 268, 426.5; 81/418, 81/420, 424.5, 426.5
See application file for complete search history.

(56) References Cited

U.S. PATENT DOCUMENTS

| | | | | |
|---|---|---|---|---|
| 1,661,365 | A | 3/1928 | Gendron | |
| 5,611,519 | A * | 3/1997 | Garcia | B25B 7/02 254/22 |
| 5,735,031 | A | 4/1998 | Johnson | |
| 6,202,517 | B1 * | 3/2001 | Dolan | B25B 7/02 81/418 |
| 6,256,855 | B1 | 7/2001 | Schall | |
| 6,473,956 | B1 * | 11/2002 | Tucker | B25B 7/02 254/28 |
| D657,219 | S | 4/2012 | Kawell et al. | |
| 2001/0004858 | A1 | 6/2001 | Kachergius | |
| 2016/0184980 | A1 * | 6/2016 | Takasaki | B25B 7/02 7/133 |

FOREIGN PATENT DOCUMENTS

WO 2009024832 A2 2/2009

* cited by examiner

*Primary Examiner* — Lee D Wilson
*Assistant Examiner* — Alberto Saenz
(74) *Attorney, Agent, or Firm* — Maginot, Moore & Beck LLP

(57) ABSTRACT

A pliers includes a first handle and a second handle. A first jaw is fixed with respect to the first handle and includes a distal tooth, a cone portion, and a blade portion. A second jaw which is fixed with respect to the second handle includes a distal tooth, a cone portion, and a blade portion. A pivot pivotably connects the two handles such that when the pliers are shut, the two teeth are aligned, the cone portions are aligned, and the blade portions are aligned.

14 Claims, 5 Drawing Sheets

PLASTIC CLIP POPPER PLIERS AND METHOD OF USE

The present disclosure relates to the field of tools and in particular to tools used in the automotive industry.

BACKGROUND

In the automotive industry a wide variety of clips are used in a variety of different applications. For example, clips are used to secure wires, cables, hoses, and tubes. Clips are also used to secure fenders, panels, trims, insulation, and brackets to other vehicular components. In many applications the clips are not exposed to significant loads. Accordingly, the clips are advantageously made from lightweight materials. Various forms of plastics re commonly used for some clips. Plastic clips are advantageously inexpensive and lightweight.

Because of the wide variety of applications, clips take on a number of different forms. In some instances a one-way clip is used. A "one-way" clip is typically a device which expands or in some other way catches on an underlying substrate so as to provide a semi-permanent connection. One type of one-way clip is provided in two components. One component functions as a base or retainer and is typically attached to an underlying substrate. The second component is threaded or snapped into the first component. The second component typically includes a stem, which may be radially resilient, and a head.

Another form of a clip is a single component with a stem and a low profile head. In this type of clip the stem is sized to snap into a hole in a substrate and the head is configured to extend radially outwardly so as to prevent movement of the head into the hole.

Unlike fasteners such as screw, bolts, and the like, clips are not made to be easily removed. Rather, they are semi-permanent in nature since the components which are fastened together using the clips are intended to be rarely separated. Additionally, since the clips can be easily inserted into position simply using a direct force, they are more convenient to use than screws or bolts in relatively inaccessible areas.

Many of the benefits provided by clips become disadvantages when it is required to remove the clips. In particular, the clips can be located in difficult to reach and low clearance areas. The low profile of the heads makes gripping the heads for removal very difficult. Because the clips are made from a lightweight material, it is easy to damage the clips making removal even more difficult. For example, when the head of a clip is broken, tools used for removal of clips by leveraging against the head are rendered useless. Finally, because of the wide variety of shapes and sizes which clips can take, it can be difficult to maintain a stock of every different type and size of clip. Consequently, care must be taken to minimize the number of clips which are damaged during removal.

Therefore, a tool which designed to remove multiple types of clips without damaging the clips would be beneficial. It would be further beneficial is the tool was capable of removing even damaged clips.

SUMMARY

According to an exemplary embodiment of the disclosure, a pliers, also referred to as plastic clip popper pliers, include a first handle and a second handle. A respective jaw is fixedly attached to each of the handles and the handles are pivotably connected by a pivot. Each of the jaws include a tooth, a cone portion, and a blade portion which, when the handles are in a closed position, align with each other.

In one or more embodiments, inner edges of the blade portions are located higher above the bottom of the jaws than the inner edges of the teeth and cone portions.

In one or more embodiments the two cone portions define an opening therebetween when the first handle and the second handle are in the closed position. This helps reduce the chances of cutting completely through the stem of a clip when using the pliers to remove the clip.

In one or more embodiments the teeth are in abutment when the first handle and the second handle are in the closed.

In one or more embodiments the cone portions are positioned between the teeth and the blade portions with the blade portions closest to the handles.

In one or more embodiments a respective tooth recess is located between each of the teeth and the respective cone portion.

In one or more embodiments one of the handles includes a shoulder and a lock is pivotably attached to the other handle. The lock is configured to selectively abut the shoulder when the two handles are in the closed position such that the handles are locked in the closed position.

In one or more embodiments a spring is located between the handles and configured to bias the handles away from the closed position.

In one or more embodiments the jaws are connected to the handles through angled portions. The angled portions are designed such that the handles move parallel to a first plane as the handles pivot about the pivot while at least a portion of the jaws do not move parallel to the plane as the handles pivot about the pivot.

In accordance with one embodiment, a method of using a pliers includes providing pliers with a pivot pivotably connecting two handles, the handles in fixed position with respective jaws. The pliers are designed such that when the handles are in a closed position, a tooth of one jaw is aligned with a tooth of the other jaw. Likewise, a cone portion of one jaw is aligned with a cone portion of the other jaw, and a blade portion of the one jaw is aligned with a blade portion of the other jaw. The method includes aligning either the teeth or the cone portions a with a clip and moving at least one of the two handles toward the other of the two handles. The teeth or the cone portions are thus moved beneath a head of the clip and used to apply force to the head of the clip. In instances wherein application of force to the head causes damage to the head, the method proceeds to aligning the blade portions with a stem of the clip and moving at least one of the two handles toward the other of the two handles. The blade portions are then used to apply force to the head of the stem.

In accordance with one or more embodiments, aligning the teeth or cone portions includes aligning an inner edge of the teeth or cone portions with the clip at a first height above a surface in which the clip is positioned and aligning the blade portions includes aligning inner edges of the blade portions with the stem at a second height above the surface which is higher than the first height.

In accordance with one or more embodiments aligning the teeth or cone portions includes positioning the pliers at a location whereat the blade portions are located between the handles and the teeth or cone portions.

In accordance with one or more embodiments, the method includes, prior to aligning the teeth or cone portions with the clip, pivoting a lock pivotably attached to one handle from a first position whereat the lock abuts a shoulder of the other handle, thereby locking the relative positions of the second handles, to a second position whereat the lock does not abut the shoulder.

In accordance with one or more embodiments, the method includes, after applying force to the head of the clip with the teeth or cone portions and prior to aligning the blade portions with the stem, biasing the handles away from each other using a spring.

BRIEF DESCRIPTION OF THE DRAWINGS

The above-described features and advantages, as well as others, should become more readily apparent to those of ordinary skill in the art by reference to the following detailed description and the accompanying figures in which.

DETAILED DESCRIPTION

Figure 1:
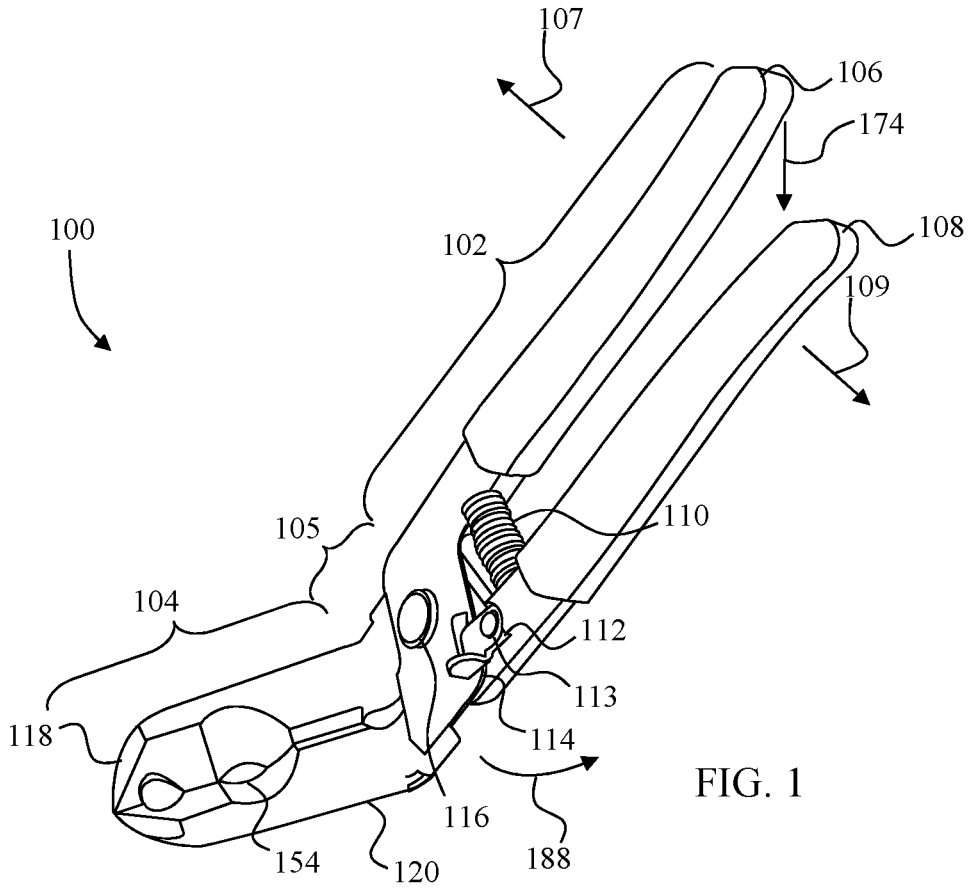
FIG. 1 is a perspective view of a plastic clip popper pliers.
Figure 2:
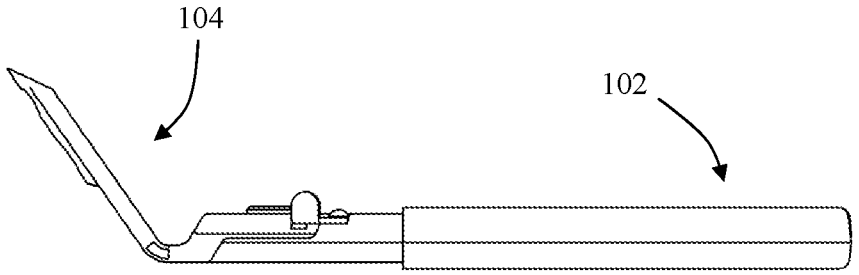
FIG. 2 is a left side view of the plastic clip popper pliers.
Figure 3:
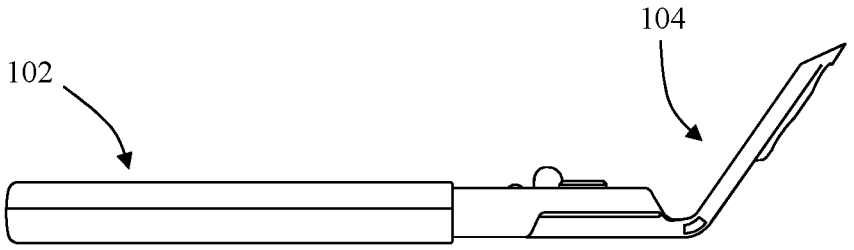
FIG. 3 is a right side view of the plastic clip popper pliers.
Figure 4:
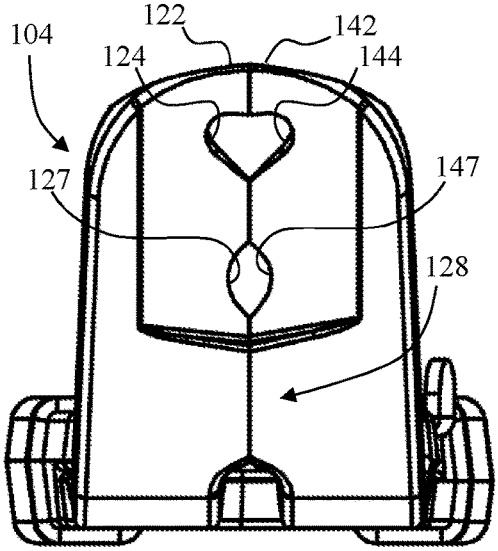
FIG. 4 is a front elevational view of the plastic clip popper pliers.
Figure 5:
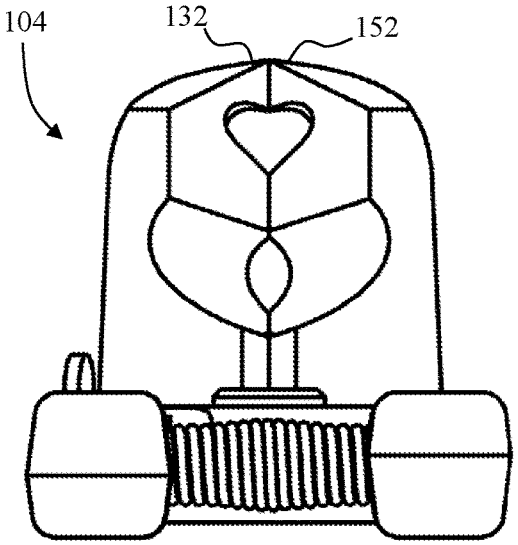
FIG. 5 is a rear elevational view of the plastic clip popper pliers.
Figure 6:
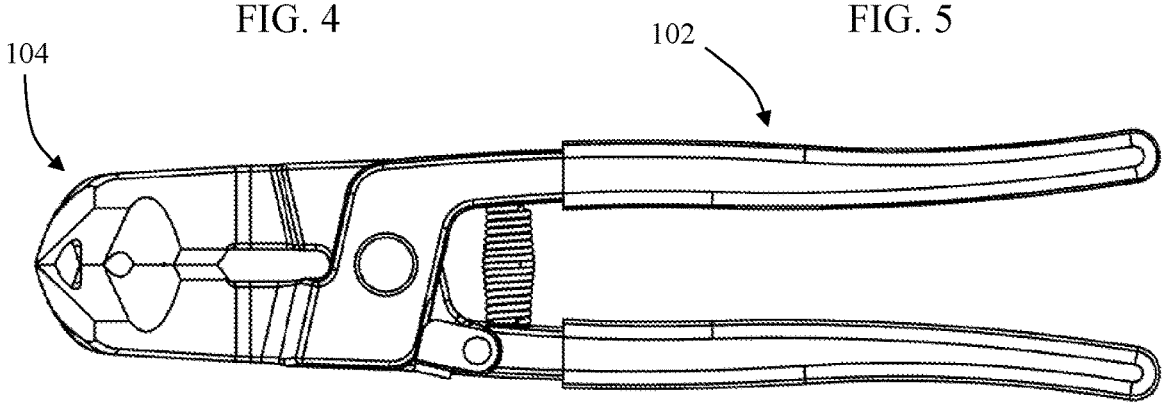
FIG. 6 is a top plan view of the plastic clip popper pliers.
Figure 7:
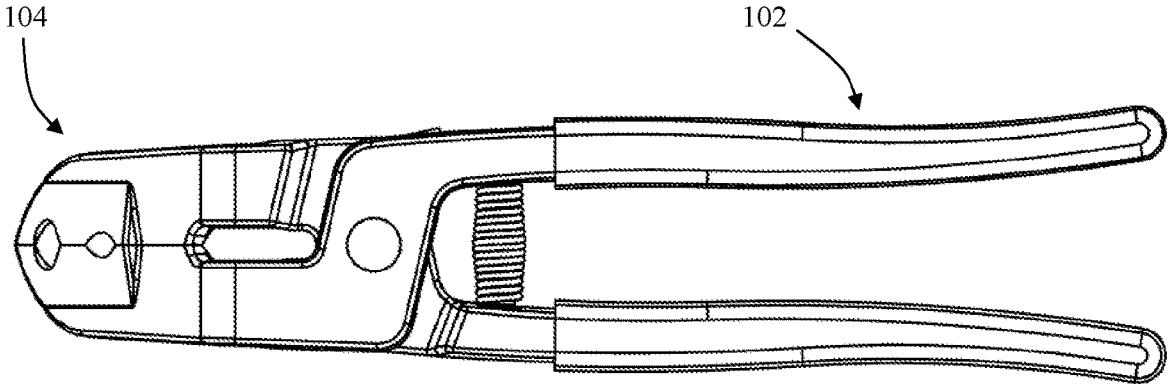
FIG. 7 is a bottom plan view of the plastic clip popper pliers.

For the purpose of promoting an understanding of the principles of the disclosure, reference will now be made to the embodiments illustrated in the drawings and described in the following written specification. It is understood that no limitation to the scope of the disclosure is thereby intended. It is further understood that this disclosure includes any alterations and modifications to the illustrated embodiments and includes further applications of the principles of the disclosure as would normally occur to one skilled in the art to which this disclosure pertains.

Aspects of the disclosure are disclosed in the accompanying description. Alternate embodiments of the disclosure and their equivalents may be devised without parting from the spirit or scope of the disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

As shown in FIGS. 1-7, plastic clip popper pliers 100 include a handle section 102 and a jaw section 104. A transition region 105 joins the jaw section 104 and the handle section 102. The handle section 102 includes two handles 106 and 108. A spring 110 is positioned in the transition region 105 and configured to bias the two handles 106 and 108 away from each other. In particular, the handle 106 is biased in the direction of the arrow 107 while the handle 108 is biased in the direction of the arrow 109. A lock 112 is pivotably attached to the handle 108 with a pivot 113 and configured to abut a shoulder 114 of the handle 106 when in a locked position as depicted in FIG. 1. The handles 106 and 108 are connected to each other by a pivot bolt 116. While the spring 110 and handles 106 and 108 are depicted in one form in FIG. 1, in other embodiments the spring 110 and handles 106 and 108 are shaped differently, and/or positioned differently.

Figure 8:
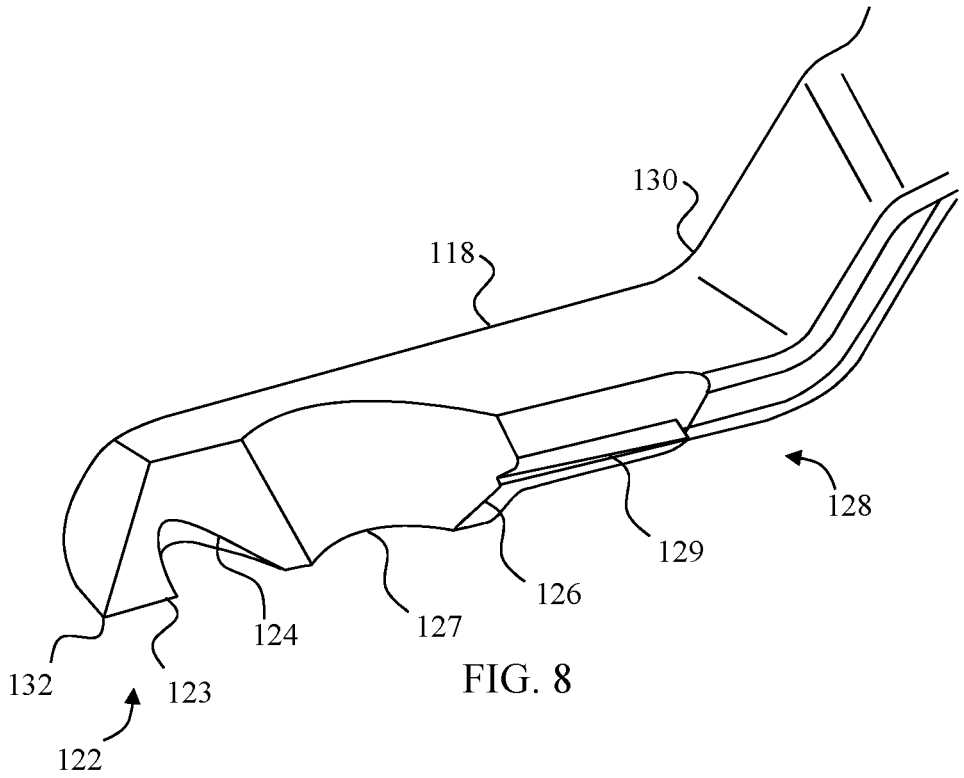
FIG. 8 is a side perspective of one of the jaws of the plastic clip popper pliers of FIG. 1.

The jaw section 104 includes two jaws 118 and 120. As shown in FIG. 8, the jaw 118 includes a tooth 122 at a distal end of the jaw 118, a tooth recess 124, a cone portion 126, and a blade portion 128. The tooth 122 and cone portion 126 each taper to a respective inner edge 123/127 at the bottom of the jaw 118. The blade portion 128 tapers to an inner edge 129 at a location higher than the inner edges 123/127 of the tooth 122 and cone portion 126 as best seen in FIG. 8. An angled portion 130 at a proximal end of the jaw 118 connects the jaw 118 to the handle 108. The distal end of the jaw 118 tapers to a point 132 at the tooth 122. While the jaw 118 and the angled portion 130 are depicted in one form in FIG. 1, in other embodiments the jaw 118 and the angled portion 130 are differently shaped. Moreover, the angled portion 130 in some embodiments is omitted.

Figure 9:
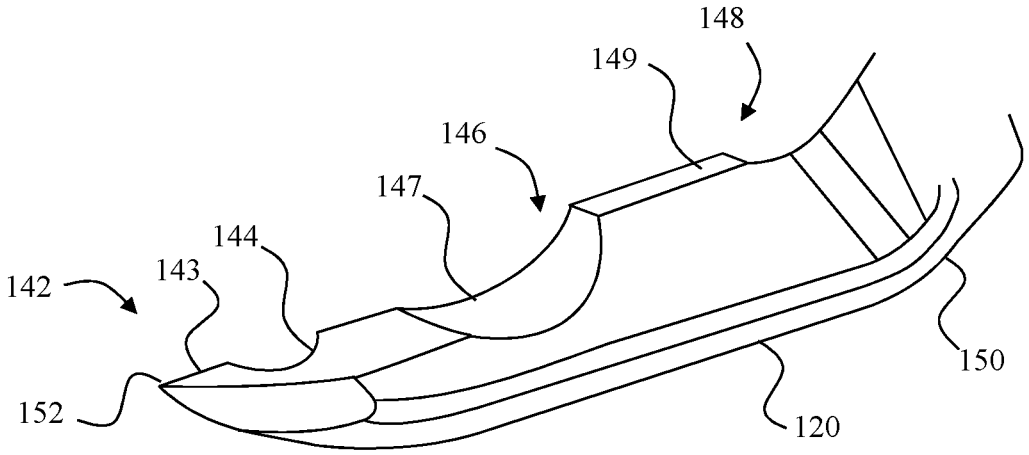
FIG. 9 is a top perspective view of one of the jaws of the plastic clip popper pliers of FIG. 1.

The jaw 120 shown in FIG. 9 includes a tooth 142 at a distal end of the jaw 120, a tooth recess 144, a cone portion 146, and a blade portion 148. The tooth 142 and cone portion 146 each taper to a respective inner edge 143/147 at the bottom of the jaw 120. The blade portion 148 tapers to an inner edge 149 at a location higher than the inner edges 143/147 of the tooth 142 and cone portion 146. An angled portion 150 at a proximal end of the jaw 120 connects the jaw 120 to the handle 106. The distal end of the jaw 120 tapers to a point 152 at the tooth 142. While the jaw 120 and the angled portion 150 are depicted in one form in FIG. 1, in other embodiments the jaw 120 and the angled portion 150 are differently shaped. Moreover, the angled portion 130 in some embodiments is omitted.

In the embodiment of FIG. 1, the jaw 118 is integrally formed with the handle 108 in the transition region 105 and the jaw 120 is integrally formed with the handle 106 in the transition region 105. In other embodiments, the handles and jaws are formed separately. The pivot bolt fastens the jaw 118/handle 108 and the jaw 120/handle 106 such that when the plastic clip popper pliers 100 are in a "closed" position as shown in FIG. 1, the teeth 122 and 142 are aligned in direct opposition to each other. Likewise, the cone portions 126 and 146 are aligned in direct opposition to each other. The blade portions 128 and 148 are at least partially aligned and at least partially in direct opposition to one another.

The jaw 118 and the jaw 120 are configured in one embodiment such that the teeth 122 and 142, cone portions 126 and 146, and blade portions 128 and 148 create contact points which limit movement of the handles 106 and 108 toward each other when the pliers are closed. In some embodiments, one or more of the teeth 122 and 142, cone portions 126 and 146, and blade portions 128 and 148 do not contact each other at the configuration whereat movement of the handles 106 and 108 toward each other is precluded. For example, in some embodiments a contact point is provided in the angled portions 130 and 150, by the spring 110 (when fully compressed), fewer than all of the teeth 122 and 142, cone portions 126 and 146, and blade portions 128 and 148, or another type of contact member on the handles or jaws which precludes further movement of the handles 106 and 108 toward each other while a gap exists between one or more of the teeth 122 and 142, cone portions 126 and 146, and blade portions 128 and 148.

In the embodiment of FIG. 1, the cone portions 126 and 146 are configured such that when the plastic clip popper pliers are fully closed (the handles 106 and 107 positioned as closely as possible to each other), an opening 154 is formed by the cone portions 126 and 146. The opening 154 precludes inadvertently cutting a clip into two pieces.

Figure 10:
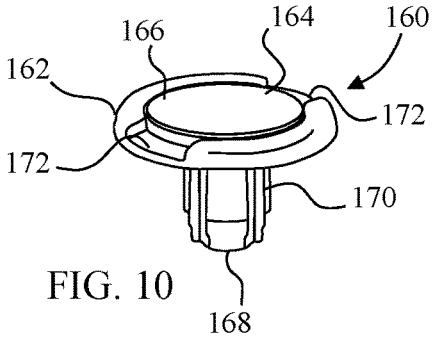
FIG. 10 is a perspective view of a clip which can be removed using the plastic clip popper pliers of FIG. 1.

The plastic clip popper pliers 100 are used to remove clips such as the clip 160 shown in FIG. 10. The clip 160 includes a base 162 and a pin 164. The clip 160 is locked by pushing the head 166 of the pin 164 thereby forcing the stem 168 of the pin 164 into the base 162. The stem 168 forces the feet 170 of the base to expand locking the clip in a substrate as is known in the art. The base 162 includes recesses 172 which are used by the plastic clip popper pliers 100 to remove the pin 164 as explained with further reference to FIGS. 1 and 11.

In particular, the teeth 122 and 142 are sized to fit within the recesses 172. Accordingly, to unlock the clip 160 starting with the plastic clip popper pliers 100 in the condition of FIG. 1, the lock 112 is pivoted around the pivot 113 in the direction of the arrow 188 from the locked position of FIG. 1 to an unlocked position whereat the lock 112 does not contact the shoulder 114 so as to preclude movement. The spring 110 then operates to open the jaws 118 and 120 by forcing the handles 106 and 108 in the direction of the arrows 107 and 109 of FIG. 1. This allows for one hand operation of the plastic clip popper pliers 100.

Figure 11:
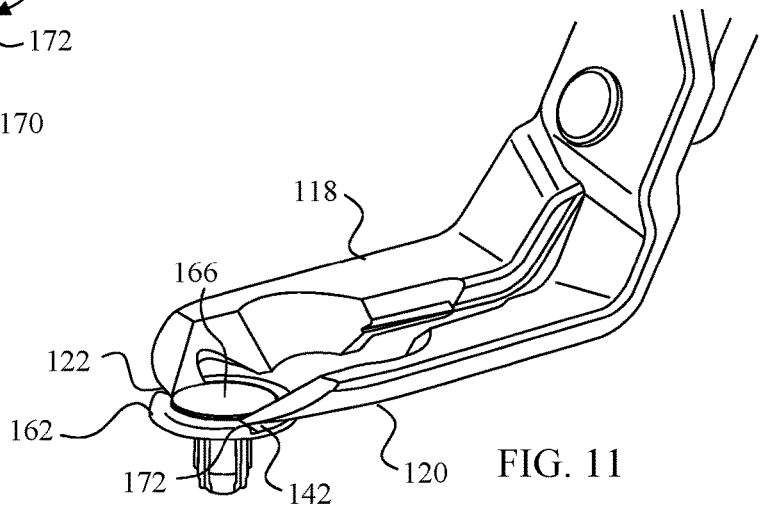
FIG. 11 is a perspective view of the teeth of the plastic clip popper pliers of FIG. 1 engaged with the clip of FIG. 10.

Once the plastic clip popper pliers 100 are unlocked, the operator aligns the teeth 122 and 142 with the recesses 172 and squeezes the handles 106 and 108. Squeezing of the handles 106 and 108 forces the handles to compress the spring 110, thereby moving the handle 108 toward the handle 106 and/or moving the handle 106 toward the handle 108. As the handles move, the jaws 118 and 120 are moved in a corresponding fashion about the pivot bolt 116 until the teeth 122 and 142 contact the head 166 as shown in FIG. 11. Further compression of the spring 110 by the operator in the manner described above forces the teeth 122 and 142 to slide beneath the head 166 forcing the pin 164 in a direction outwardly from the base 162. The tapers of the tooth recess 124 and the tooth recess 144 are designed to allow the teeth 122 and 142 to move beneath the head 166 and to contact the stem 168 without the jaws 118 and 120 otherwise contacting the clip 160 as the operator continues to move the handles 106 and 108 toward each other.

Once the teeth 118 and 120 are positioned beneath the head 166 to the desired degree, typically with the teeth 118 and 120 touching the stem 168, the operator pushes the handles 106 and 108 in the direction of the arrow 174 in FIG. 1. This movement forces the jaws 118 and 120 against a surface adjacent to the base 162 and the angled portions 130 and 150 are used as a fulcrum to force the pin 164 outwardly of the base 162. Additionally and/or alternatively, jaw 118 and jaw 120 are used as fulcrums in a side-to-side movement, and/or the handles are simply pulled upwardly to force the pin 164 outwardly of the base 162.

Figure 12:
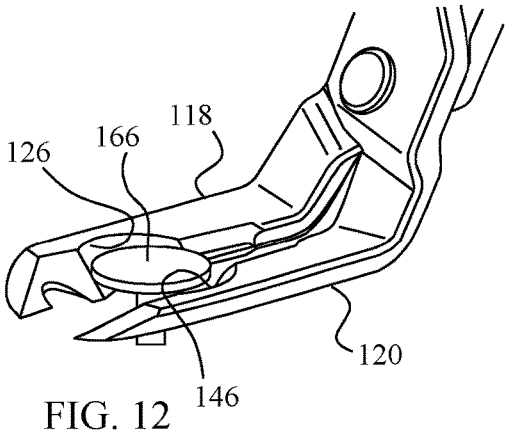
FIG. 12 is a perspective view of the cone portions of the plastic clip popper pliers of FIG. 1 engaged with the clip of FIG. 10.

In some instances, the pin 164 is lifted free of the base 162 using only the teeth 122 and 142. In other instances, after the pin 164 is partially withdrawn from the base 162, the operator shifts the plastic clip popper pliers so that the cone portions 126 and 146 are under the head 166 as shown in FIG. 12 to complete withdrawal of the pin 164.

Figure 13:
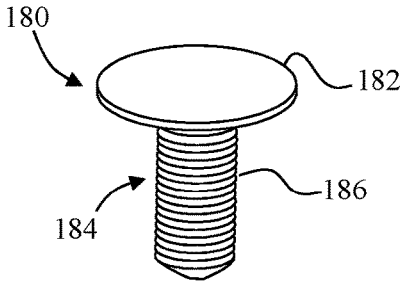
FIG. 13 is a perspective view of a clip which can be removed using the plastic clip popper pliers of FIG. 1.

The plastic clip popper pliers 100 are also used to remove clips such as the clip 180 shown in FIG. 13. The clip 180 includes a head 182 and a stem 184. A number of resilient ridges 186 are provided on the stem 184. The clip 180 is locked by pushing the head 182 of the clip 180 with the stem 184 aligned with an opening in a substrate thereby forcing the stem 184 into the hole. The stem 184 and resilient members 186 are sized such that the resilient members 186 are deformed as the head 182 is pressed toward the opening allowing the stem 184 and resilient members 186 to pass into the opening. Once within/beneath the substrate in which the opening is located, the resilient members 186 revert to their original shape, thereby locking the clip 180 to the substrate.

While is it possible to use the teeth 122 and 142 of the plastic clip popper pliers 100 to remove the clip 180 from the substrate, typically the cone portions 126 and 146 are used. Removal of the clip in such embodiments includes aligning the portions of the cone portions 126 and 146 which define the opening 154 with the stem 184 of the clip 180 while at least one of the jaws 118 and 120 is resting on the substrate. At this time, or at an earlier time, the lock 112 is pivoted around the pivot 113 in the direction of the arrow 188 from the locked position of FIG. 1 to an unlocked position whereat the lock 112 does not contact the shoulder 114 so as to preclude movement. One of the cone portions 126/146 is then placed against the head 182 of the clip 180. The operator then squeezes the handles 106 and 108. Squeezing of the handles 106 and 108 forces the handles to compress the spring 110, thereby moving the handle 108 toward the handle 106 and/or moving the handle 106 toward the handle 108.

As the handles move, the jaws 118 and 120 are moved in a corresponding fashion about the pivot bolt 116 until both of the cone portions 126 and 146 contact the head 182. The tapers of the cone portions 126 and 146 are designed such that the bottom edges of the cone portions 126 and 146 move between the bottom of the head 182 and the surface as the operator continues to move the handles 106 and 108 toward each other.

Figure 14:
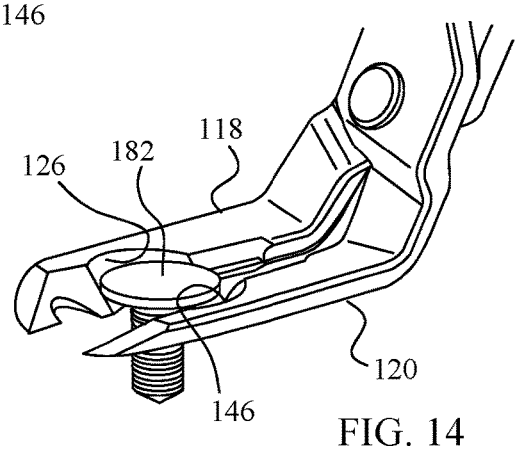
FIG. 14 is a perspective view of the cone portions of the plastic clip popper pliers of FIG. 1 engaged with the clip of FIG. 13.

Once the cone portions 126 and 146 are positioned beneath the head 166 to the extent desired (see, e.g., FIG. 14), the operator pushes the handles 106 and 108 in the direction of the arrow 174 in FIG. 1. This movement forces the jaws 118 and 120 against a surface adjacent to the head 182 and the angled portions 130 and 150 are used as a fulcrum to force the stem 184 outwardly of the surface. Additionally and/or alternatively, jaw 118 and jaw 120 are used as fulcrums in a side-to-side movement, and/or the handles 106 and 108 are simply pulled upwardly to force the stem 184 outwardly of the opening in the substrate. Because the cone portions 126 and 146 are centrally located on the jaws 118 and 120, the teeth 122 and 132 are also used additionally/alternatively as a fulcrum.

In the event the head of a clip is damaged, such as the head 166 of the clip 160 in FIG. 10 or the head 182 of the clip 180 in FIG. 13, the blade portions 128 and 148 are used to remove the damaged clip. Removal of the damaged clip includes aligning the blade portions 128 and 148 with the stem of the clip. Because the edges of the blade portions 128 and 148 are located higher than the edges of the teeth 122/142 and cone portions 126/146, the distal teeth 122/142 or the angled portions 130/150 are typically positioned on the surface adjacent to the damaged clip and the plastic clip popper pliers 100 are pivoted about the contact point rearwardly (i.e., when the distal teeth provide the fulcrum) or forwardly (i.e. when the angled portions provide the fulcrum) until the stem of the damaged clip is located between the blade portions 128 and 148. At this time, or at an earlier time, the lock 112 is pivoted around the pivot 113 in the direction of the arrow 188 from the locked position of FIG. 1 to an unlocked position whereat the lock 112 does not contact the shoulder 114 so as to preclude movement.

The operator then squeezes the handles 106 and 108. Squeezing of the handles 106 and 108 forces the handles to compress the spring 110, thereby moving the handle 108 toward the handle 106 and/or moving the handle 106 toward the handle 108. As the handles move, the jaws 118 and 120 are moved in a corresponding fashion about the pivot bolt 116 until both of the blade portions 128 and 148 contact the stem of the damaged clip. Because the tapered edges of the blade portions 128 and 148 are higher than the edges of the teeth 122/142 and the cone portions 126/146, the blade portions 128 and 148 are aligned with the stem rather than the damaged head. Additionally, the head does not interfere with acquiring a good grip on the stem with the blade portions 128 and 148.

Figure 15:
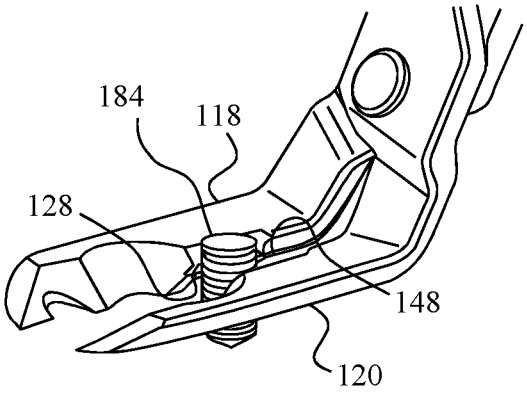
FIG. 15 is a perspective view of the blade portions of the plastic clip popper pliers of FIG. 1 engaged with the stem of the clip of FIG. 13.

Once the blade portions 128 and 148 are engaged with the stem to the extent desired, as shown for example in FIG. 15 using the stem 184, the operator pushes the handles 106 and 108 in the direction of the arrow 174 in FIG. 1. This movement forces the jaws 118 and 120 against a surface adjacent to the head 182 and the angled portions 130 and 150 are used as a fulcrum to force the stem 184 outwardly of the surface. Additionally and/or alternatively, jaw 118 and jaw 120 are used as fulcrums in a side-to-side movement, and/or the handles 106 and 108 are simply pulled upwardly to force the stem 184 outwardly of the opening in the substrate. Because the blade portions 128 and 148 are proximally located on the jaws 118 and 120, the teeth 122 and 132 are also used additionally/alternatively as a fulcrum.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. A pliers, comprising:

a first handle;

a second handle;

a first jaw fixed with respect to the first handle and including a first tooth, a first cone portion, and a first blade portion;

a second jaw fixed with respect to the second handle and including a second tooth, a second cone portion, and a second blade portion; and a pivot pivotably connecting the first handle and the second handle such that when the first handle and the second handle are in a first position, the first tooth is aligned with the second tooth, the first cone portion is aligned with the second cone portion, and the first blade portion is aligned with the second blade portion, wherein:

the first jaw has a top side and a bottom side;

the first cone portion tapers upwardly and outwardly from an inner edge proximate the bottom side, the inner edge located at a first height above a bottom-most portion of the first jaw, to an outer edge proximate the top side;

the first blade portion tapers to an inner edge which is at a second height above the bottom-most portion of the first jaw; and the second height is higher than the first height.

2. The pliers of claim 1, wherein:

the first cone portion and the second cone portion define an opening therebetween when the first handle and the second handle are in the first position.

3. The pliers of claim 2, wherein:

the first tooth and the second tooth are in abutment when the first handle and the second handle are in the first position.

4. The pliers of claim 1, wherein:

the first cone portion is positioned between the first tooth and the first blade portion; and the first blade portion is located between the first cone portion and the first handle.

5. The pliers of claim 4, further comprising:

a tooth recess located between the first tooth and the first cone portion.

6. The pliers of claim 1, wherein:

the first handle includes a shoulder;

a lock is pivotably attached to the second handle; and the lock is configured to selectively abut the shoulder when the first handle and the second handle are in the first position such that the first handle and the second handle are locked in the first position.

7. The pliers of claim 1, further comprising:

a spring located between the first handle and the second handle and configured to bias the first handle and the second handle away from the first position.

8. The pliers of claim 1, wherein:

the first jaw is connected to the first handle through an angled portion;

the angled portion is configured such that the first handle moves parallel to a first plane as the first handle pivots about the pivot and at least a portion of the first jaw does not move parallel to the first plane as the first handle pivots about the pivot.

9. The pliers of claim 1, wherein the bottom-most portion of the first jaw is configured to be positioned beneath a head of a clip.

10. A method of using a pliers, comprising:

providing pliers including a pivot pivotably connecting a first handle and a second handle, the first handle in fixed position with a first jaw and the second handle in fixed position with a second jaw, such that when the first handle and the second handle are in a first position, a first tooth of the first jaw is aligned with a second tooth of the second jaw, a first cone portion of the first jaw is aligned with a second cone portion of the second jaw, and a first blade portion of the first jaw is aligned with a second blade portion of the second jaw;

aligning a pair selected from a group of pairs consisting of (i) the first tooth and the second tooth, and (ii) the first cone portion and the second cone portion, with a clip;

moving at least one of the first handle and the second handle toward the other of the first handle and the second handle with the selected pair aligned with the clip;

moving the selected pair beneath a head of the clip with respective bottom sides of the first and second jaws beneath the head of the clip;

applying force to the head of the clip with the selected pair beneath the head of the clip;

aligning the first blade portion and the second blade portion with a stem of the clip after applying force to the head of the clip with the selected pair;

moving at least one of the first handle and the second handle toward the other of the first handle and the second handle with the first blade portion and the second blade portion aligned with the stem; and applying force to the head of the stem with the first blade portion and the second blade portion, wherein:

the first and second cone portions taper upwardly and outwardly from the respective bottom sides of the first and second jaw to respective top sides of the first and second jaw;

aligning the selected pair with the clip includes aligning inner edges of the selected pair with the clip with the inner edges at a first height above a surface in which the clip is positioned;

aligning the first blade portion and the second blade portion with the stem of the clip includes aligning inner edges of the first blade portion and the second blade portion with the stem with the inner edges at a second height above the surface in which the clip is positioned; and the second height is higher than the first height.

11. The method of claim 10, wherein aligning the selected pair with the clip; comprises:

positioning the pliers at a location whereat the first and second blade portions are located between the first and second handles and the selected pair.

12. The method of claim 10, further comprising, prior to aligning the selected pair with the clip:

pivoting a lock pivotably attached to the second handle from a first position whereat the lock abuts a shoulder of the first handle thereby locking the relative positions of the first handle and the second handle to a second position whereat the lock does not abut the shoulder.

13. The method of claim 10, further comprising, after applying force to the head of the clip with the selected pair beneath the head of the clip and prior to aligning the first blade portion and the second blade portion with the stem:

biasing the first handle away from the second handle using a spring.

14. A pliers, comprising:

a first handle;

a second handle;

a first jaw fixed with respect to the first handle and including a first tooth, a first cone portion, and a first blade portion;

a second jaw fixed with respect to the second handle and including a second tooth, a second cone portion, and a second blade portion; and a pivot pivotably connecting the first handle and the second handle such that when the first handle and the second handle are in a first position, the first tooth is aligned with the second tooth, the first cone portion is aligned with the second cone portion, and the first blade portion is aligned with the second blade portion, wherein the first tooth and the second tooth are configured to be simultaneously positioned at least partially beneath a head of a clip in a substrate, and the first cone portion and the second cone portion are configured to be simultaneously positioned at least partially beneath the head of the clip in the substrate.

* * * * *